United States Patent [19]

Link

[11] Patent Number: 4,548,001

[45] Date of Patent: Oct. 22, 1985

[54] CLEANING APPARATUS AND METHOD

[76] Inventor: John Link, 188 Bay St., Port Melbourne 3207, Victoria, Australia

[21] Appl. No.: 264,393

[22] Filed: May 18, 1981

[30] Foreign Application Priority Data

May 16, 1980 [GB] United Kingdom ..... 8016253

[51] Int. Cl.[4] ..... B24C 7/00

[52] U.S. Cl. ..... 51/410; 51/436; 51/321; 406/153

[58] Field of Search ..... 51/410, 427, 429, 436, 51/263, 439, 292, 319, 320, 321; 239/310, 318, 142, 143; 406/153, 93, 94; 417/163, 54, 151

[56] References Cited

U.S. PATENT DOCUMENTS

| | | | |
|---|---|---|---|
| 1,925,751 | 9/1933 | Diffenderffer | 51/263 |
| 2,042,120 | 5/1936 | Palmiter | 51/436 |
| 2,317,837 | 4/1943 | Webster | 51/428 |
| 2,612,731 | 10/1952 | Gladfelter et al. | 51/439 |
| 2,876,601 | 3/1959 | McFadden | 51/321 |
| 3,150,467 | 9/1964 | Umbricht et al. | 51/321 |
| 3,158,101 | 11/1964 | Dollar | 417/151 |
| 3,323,257 | 6/1967 | Fonti | 51/410 |
| 3,514,905 | 6/1970 | King et al. | 51/428 |
| 3,994,097 | 11/1976 | Lamb | 51/436 |

FOREIGN PATENT DOCUMENTS

| | | | |
|---|---|---|---|
| 683305 | of 1930 | France | 51/319 |
| 731117 | of 1955 | United Kingdom | 51/436 |
| 2056333 | 3/1981 | United Kingdom | 51/436 |

*Primary Examiner*—Frederick R. Schmidt
*Assistant Examiner*—Robert A. Rose
*Attorney, Agent, or Firm*—Fleit, Jacobson, Cohn & Price

[57] ABSTRACT

Cleaning apparatus employing an abrasive laden water jet including a tank for water and abrasive, an eductor in the tank to one inlet of which a water supply is connected and another inlet of which is open to the water abrasive mixture, a mechanism, which may be the eductor, to fluidize the abrasive in the water in the tank, a line from the outlet of the eductor to a working nozzle which is supplied with water and abrasive mixture by the action of the water supply in the eductor, and a high pressure water line adjacent the nozzle to increase the velocity of flow of the mixture from the nozzle.

5 Claims, 2 Drawing Figures

CLEANING APPARATUS AND METHOD

DESCRIPTION

Figure 1:
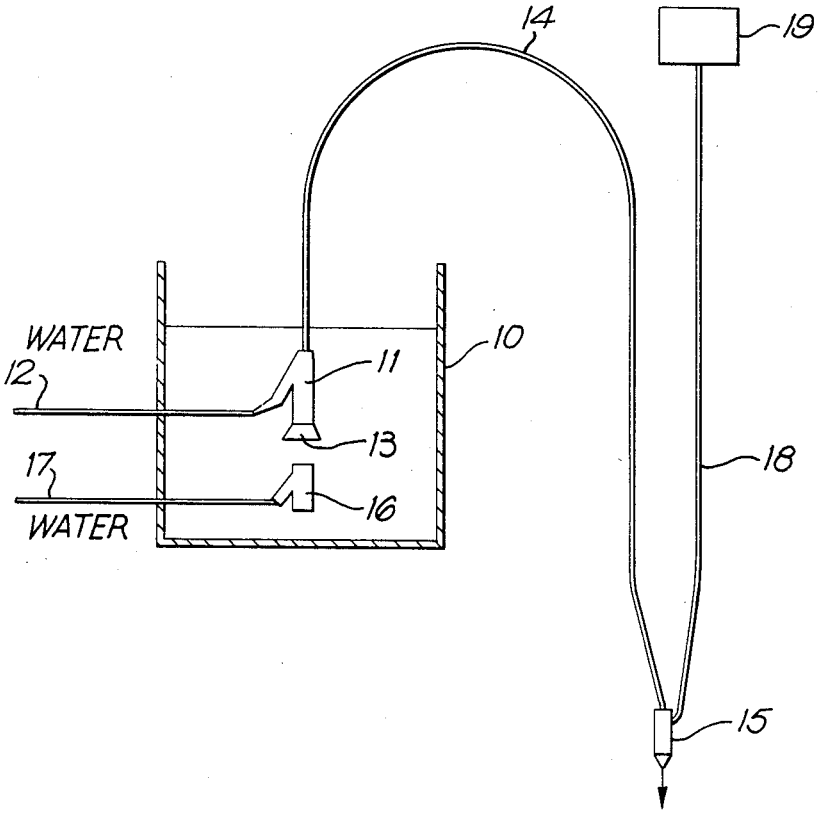

This invention relates to cleaning apparatus and a cleaning method employing abrasive laden jets of water.

The use of abrasive laden jets is common in cleaning such items as the legs of oil rigs, but such a situation creates special difficulties because the cleaning is actually performed by a diver who may be some way below the sea water surface. It has been proposed for an abrasive container to be lowered to the region of the diver and pressurised by a pump at the surface connected by a line to the container. A problem here is that the supply of abrasive does not last very long and a large proportion of the diver's time below water is spent renewing his abrasive supply. It has also been proposed to supply the abrasive and water mixture from the surface, and either pump it all the way down to the diver by a high pressure pump arrangement or by a suction effect created by a venturi in the nozzle held by the diver. Either way the energy involved is considerably greater than it theoretically need be while there is also a problem that the supply line for the mixture tends to delaminate at the high pressures required.

It is now proposed to provide cleaning apparatus employing an abrasive laden water jet including a tank for water and abrasive, in which the water level will be maintained constant, an eductor in the tank to one inlet of which a water supply is connected and another inlet of which is open to the water abrasive mixture, means, which may be the said eductor, to fluidize the abrasive in the water in the tank, a line from the outlet of the eductor to a working nozzle which is supplied with water and abrasive mixture by the action of said water supply to the eductor, and means adjacent the nozzle to increase the velocity of flow of the mixture out of the nozzle.

In another aspect the invention provides a method of cleaning employing a water and abrasive mixture wherein the abrasive is held in a tank in which a constant water level is maintained, abrasive is fluidized in the tank, the mixture is removed from the tank via an eductor to which a water supply is connected, and passed by a line to a nozzle, and the velocity of the mixture is increased at the nozzle by another source of energy.

Preferably the fluidization is brought about by a second eductor mounted close to the first and the purpose is to ensure that an appropriate water abrasive mixture is at all times available at the entrance to the eductor for passage down the line to the nozzle.

The container can be open topped and this means that it can be continuously replenished with abrasive, and it can readily be arranged for the water level to remain constant. Accordingly, there is no problem of mixture supply to hamper the work of the diver who may well be several hundred feet below sea level. Relatively little energy is used to convey the mixture to the nozzle and this is in itself advantageous and also means that the life of the line connecting the eductor to the nozzle is increased. Furthermore, because the abrasive, which will of course normally be sand, is never subjected to high pressure it will not itself be comminuted and destroyed as an effective cleaning agent while the continuous fluidization and maintained water level in the container ensure that a proper supply of mixture is always available and no bridging or other drawback in the container such as previously experienced is likely to occur.

While the fluidization in the container will normally be by water, it is possible alternatively to employ air supplied, for instance, through a plurality of openings in a conduit located in the bottom of the container. However, the use of air is disadvantageous insofar as bubbles are likely to occur in the pipe to the nozzle and irregularity of supply at the nozzle may result.

Figure 2:
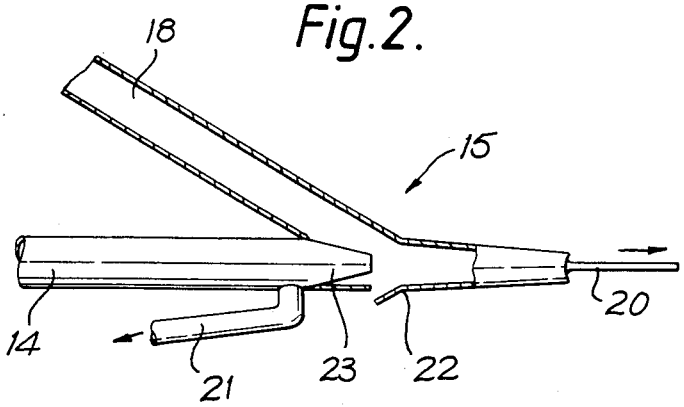

The invention will be more clearly understood from the following description which is given by way of example only with reference to the accompanying drawings, in which:

FIG. 1 is an overall schematic view of one form of apparatus according to the invention; and FIG. 2 is a schematic view showing a nozzle useful in apparatus of the invention.

As shown in FIG. 1 a container 10 can be continuously supplied with sand or other abrasive and water to maintain a constant water level as indicated. Within the container is a first eductor 11 to which water at normal mains pressure is supplied through a line 12, this eductor having a second inlet at 13 through which abrasive water mixture is drawn by the eduction effect of the water through the line 12 and is carried through a line 14 down to a nozzle 15 which may be a long distance below the level of the container 10. The eductor 11 may be sufficient to fluidize the abrasive in the water if the abrasive is of particularly high quality but to ensure fluidization it is preferable to provide separate fluidization means, and while this can take the form of a conduit, for instance conducting air or water and with a plurality of perforations located near the bottom of the container, a preferred means for this is, as illustrated, a second eductor 16 located in the container below the eductor 11 and to which again water at mains pressure is supplied through a line 17. The effect of this is to ensure that adjacent the inlet 13 of the eductor 11 the water abrasive mixture is always fluidized. Supplying additional energy at the nozzle 15 via a line 18 is a water pump 19 also at the surface in the case where the nozzle is to be used under water.

Shown in FIG. 2 is an example of an appropriate nozzle indicating how the line 18 supplies high pressure water so as to increase the rate of flow of the mixture through the line 14, and ensure that a mixed flow jet is available at the outlet 20 of the nozzle. A high pressure nozzle 23 produces eduction in the mixing chamber contained within the nozzle 15 so that the abrasive supplied through line 14 is entrained and accelerated through outlet 20. A reverse dump outlet 21 operates in the rearward direction from the outlet 20 of the nozzle so that when used under water the nozzle will not simply cause the user to be propelled away from his target. There is also a bleed valve 22 to be adjustable for a further supply of water into the nozzle thus increasing or decreasing the abrasive content of the jet exiting from the outlet 20.

Although eductor 11 in FIG. 1 is shown oriented with its axis vertical, it could have other orientations without impairing efficiency. The arrangement of reverse dump outlet 21 and bleed valve 22 can be altered as appropriate to achieve best effects as will be clear to those skilled in the art.

I claim:

1. Cleaning apparatus employing an abrasive laden water jet, for abrasive cleaning of structures such as legs of oil rigs which are spaced from sources of abrasive and energy, such apparatus including:

(a) a tank to contain a mixture of water and abrasive, (b) an eductor in said tank, said eductor having first and second inlets and an outlet, (c) a water supply connected to said first inlet of said eductor, (d) said second inlet of said eductor being open to the water abrasive mixture, (e) means to fluidize the abrasive in the water in the tank, (f) a source of high pressure fluid, (g) a remote working nozzle having first and second inlets leading to an outlet, said remote working nozzle being remote both from said tank and said source of high pressure fluid, (h) a first line leading from the outlet of said eductor, said first line extending from said tank to said first inlet of said remote working nozzle to supply in use said water and abrasive mixture to said remote working nozzle by the action of said water supply in said eductor, (i) a second line leading from said source of high pressure fluid to said second inlet of said remote working nozzle to supply, in use, high pressure fluid to said remote working nozzle, whereby, in use, said water and abrasive mixture travels from said tank to said remote working nozzle at relatively low pressure to reduce wear in said first line and is accelerated in said remote working nozzle by said high pressure fluid which travels to said nozzle without entrained abrasive.

2. Apparatus according to claim 1, further comprising a second eductor provided in the tank beneath the first eductor, the second eductor also being supplied with water to ensure availability of fluidized water abrasive mixture at the second inlet to the first eductor.

3. Apparatus according to claim 1 including additional means to fluidize the water abrasive mixture, such means comprising inlets for water or air in the bottom of said tank.

4. Cleaning apparatus as claimed in claim 1 wherein said eductor comprises said means to fluidize the abrasive in the water in the tank.

5. A method of cleaning employing an abrasive laden water jet for abrasive cleaning of structures such as the legs of oil rigs which are spaced from sources of abrasive and energy comprising (a) holding a water abrasive mixture in a tank in which a constant water level is maintained, (b) fluidizing said water abrasive mixture in the tank, (c) removing the mixture from the tank via an eductor to which a water supply is connected, (d) passing the mixture from the tank to a first inlet of a remote working nozzle which is remote from the tank, and (e) passing a source of high pressure fluid, from which the remote working nozzle is also remote, by another line to a second inlet on the remote working nozzle, said inlets leading to an outlet of the nozzle, whereby the mixture travels at relatively low pressure from said tank to said nozzle and is accelerated in said nozzle by said high pressure fluid.

* * * * *